United States Patent [19]

Harris

[11] 4,087,946

[45] May 9, 1978

[54] CONSTRUCTION METHODS

[76] Inventor: Robert H. Harris, 1900 Paula Dr., Jonesboro, Ark. 72401

[21] Appl. No.: 781,965

[22] Filed: Mar. 28, 1977

[51] Int. Cl.[2] ..... E04B 1/00; E04B 5/48

[52] U.S. Cl. ..... 52/105; 52/220

[58] Field of Search ..... 52/105, 173, 220, 221, 52/515; 4/192, 172.19; 116/114 AJ, DIG. 1; 285/93

[56] References Cited

U.S. PATENT DOCUMENTS

| | | | |
|---|---|---|---|
| 1,702,652 | 2/1929 | Jones | 116/114 AJ |
| 2,671,158 | 3/1954 | Rubenstein | 52/220 |
| 2,951,006 | 8/1960 | Rubenstein | 52/309.3 X |
| 3,360,008 | 12/1967 | Papale et al. | 52/220 X |
| 3,367,370 | 2/1968 | Sherlock | 52/105 |
| 3,468,094 | 9/1969 | Campbell | 52/105 X |
| 3,707,165 | 12/1972 | Stahl | 52/220 |

*Primary Examiner*—J. Karl Bell

*Attorney, Agent, or Firm*—Cushman, Darby & Cushman

[57] ABSTRACT

An improved method of constructing a building wherein separate pipes for hot and cold water are passed through a floor or wall structure and the opposite ends of each of these pipes are subsequently connected to appropriate water supply and water discharge means. The improvement comprises positioning a loosely fitted plastic sheath over each pipe at the point where the pipe passes through the floor or wall structure so that the sheath is exposed on both sides of the structure, the sheath for the hot water pipe having one color and the sheath for the cold water pipe having a different color so that identification and connection of each pipe to the appropriate water supply and/or discharge means is facilitated.

13 Claims, 3 Drawing Figures

CONSTRUCTION METHODS

The invention is concerned with certain novel improvements for identifying and protecting copper or steel water pipes during building construction.

When a building is under construction, it is necessary to pass the pipes which will subsequently carry hot and cold water, through walls or other building members, e.g. a concrete floor. This creates a problem for plumbers and/or other workers in determining which pipe is for the hot water and which is for the cold water. Usually these workers have to trace the pipelines through the concrete floor or similar structural member by blowing through them. However, this is obviously an inconvenient and time-consuming technique.

The principal object of the invention is to provide a very simple color coding system using different colored plastic tubing which can be loosely fitted over those portions of the pipes which pass through the floor or the equivalent so that workers can readily tell just which pipe is involved.

Another object of the invention is to provide inexpensive means for protecting pipes against the effects of lime and/or other construction chemicals as the pipes pass through concrete floors or equivalent building structures. Other objects will also be hereinafter apparent.

The invention is described in more detail below with reference to the accompanying drawings wherein.

Broadly defined, the invention contemplates an improved method of constructing a building wherein separate pipes for hot and cold water are passed through a floor or wall structure and the opposite ends of each of these pipes are subsequently connected to appropriate water supply and water discharge means. The improvement comprises positioning a loosely fitted plastic sheath over each pipe at the point where the pipe passes through the floor or wall structure so that the sheath is exposed on both sides of the structure, the sheath for the hot water pipe having one color and the sheath for the cold water pipe having a different color so that identification and connection of each pipe to the appropriate water supply and/or discharge means is facilitated.

Figure 1:
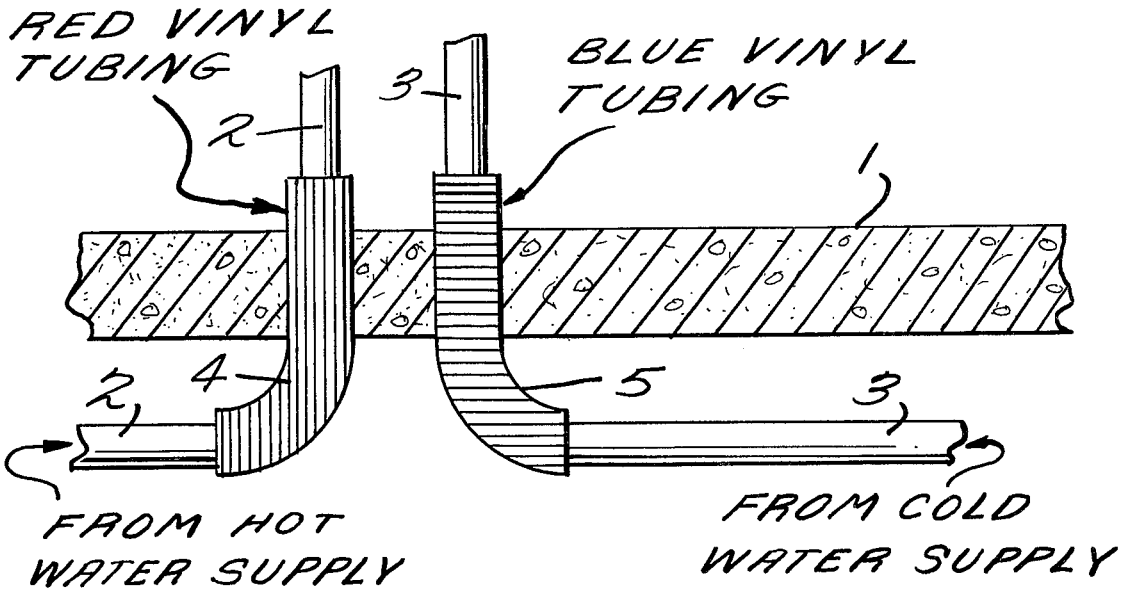
FIG. 1 is a side elevation view showing an embodiment of the invention.

Referring more specifically to the drawings, the embodiment of FIG. 1 shows a concrete slab or floor 1 through which hot and cold water pipes 2 and 3, respectively, are passed. As shown, a plastic sheath or tubing 4, preferably made of vinyl, e.g. polyvinyl chloride or equivalent material, is loosely fitted over pipe 2 so as to extend beyond both sides of the slab or floor 1. Tubing 4 is color-coded red to indicate to the plumber or mechanic on the building site that pipe 2 is for hot water. A blue-colored tubing 5, which is identical with tubing 4 except for the color difference, is similarly placed over the cold water line 3. The mechanic or plumber on the site can immediately tell from the color of tubings 4 and 5 whether hot or cold water is involved. By using this system throughout the building construction where the pipes pass through floors and/or walls, the plumber, for example, can immediately tell which pipe should be connected to the hot water supply and to the cold water supply.

Figure 2:
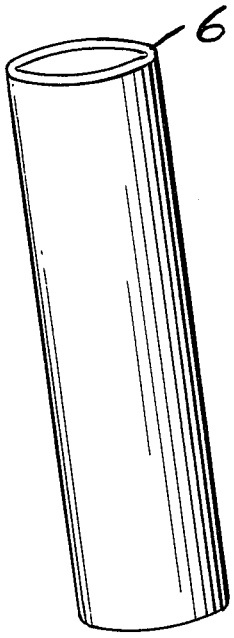
FIG. 2 is a perspective view of the tubing used for present purposes.

As noted above, tubings 4 and 5 are advantageously polyvinyl chloride or equivalent vinyl material. However, other plastic tubing may be used provided it is inert, resistant to water, acids, weather and other elements conventionally encountered on a construction site. Additionally, for ease of handling, the tubing should be sufficiently stiff or rigid so as not to bend of its own weight when a length of, for example, 2–12 inches is held vertically. However, the tubing should also be flexible enough to be readily and easily fitted over pipe and bent as necessary to accommodate for bends in the pipe. While the tubing may be cylindrical in cross-section, it is preferably essentially elliptical as shown at 6 in FIG. 2.

Figure 3:
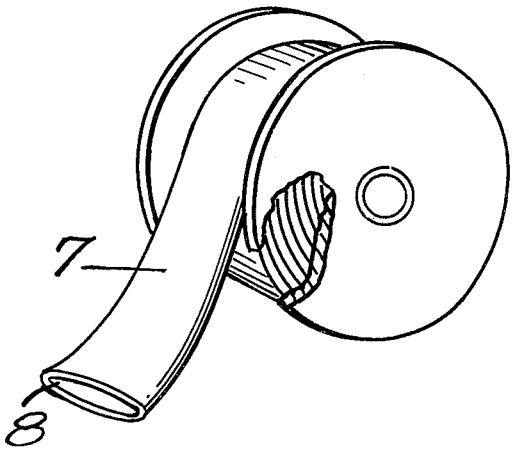
FIG. 3 is a perspective view of a coiled supply of tubing for use at a building site.

For use, each tubing is advantageously provided at the site in the form of long coil 7 as shown in FIG. 3. The desired length of tubing can be unrolled and cut from the coil as needed for application to the pipes. It will be appreciated that at least two differently colored coils 7 of tubing will be provided at each site, one to provide the color (e.g. red) used to designate the hot water line and the other the color (e.g. blue) to mark the cold water line. Advantageously the tubing is sufficiently flexible that, in the coil form, it is essentially flattened in cross-section as shown at 8. In this way, a maximum amount of tubing can be provided in a minimum of space.

The diameter of the tubing will vary depending on the diameter of the pipe involved. In any case, the tubing diameter desirably is such that when it is placed over the pipe, it fits fairly loosely thus accommodating for any expansion of the pipes caused by heat. The pipes are also free to contract without effecting the plastic sleeves.

The thickness of the plastic tubing can be varied depending on the plastic material involved and other factors. However, with polyvinyl chloride, a desirable tube thickness will usually be in the range of 1/6 inch to ¼ inch. With appropriately plasticized polyvinyl chloride this will give a flexible tubing which can be rolled up to give a compact coil of flattened tubing.

It will be recognized that various modifications may be made in the invention as described above.

Hence, the scope of the invention is defined in the following claims wherein I claim:

1. A method of building construction comprising passing a plurality of utility pipes through a floor or wall structure defining an interior building space, and disposing a loosely fitting sheath of flexible plastic material resistant to corrosive elements around each said pipe so that each sheath terminates shortly past the floor or wall in the interior building space, and completely surrounds and protects the pipe in the area extending through the floor or wall, and so that relative thermal expansion and contraction between the pipe and the floor or wall can take place without destructive effects on the pipe, the sheaths being of different colors and the sheaths being disposed on a pipe indicating what utility is associated with that pipe.

2. A method as recited in claim 1 wherein the utility pipes include a hot water pipe and a cold water pipe, and wherein said disposing step is accomplished by providing a red-colored sheath around the hot water pipe, and a blue-colored sheath around the cold water pipe.

3. A method as recited in claim 2 wherein the floor or wall comprises concrete, and wherein said step of disposing a sheath on each pipe is accomplished by disposing the sheath on the pipe overlapping the area to be encompassed by the concrete before the concrete is poured.

4. A method as recited in claim 3 wherein the sheath is polyvinyl chloride.

5. A method as recited in claim 1 wherein said step of disposing a loosely fitting sheath of plastic around the pipes is accomplished by providing a coil of flexible plastic tubing having an essentially elliptical cross-section when in use, but is essentially flattened when on the coil, and cutting a piece of tubing of sufficient length from the coil, and then disposing the cut tubing length around the pipe.

6. A method as recited in claim 1 wherein the floor or wall comprises concrete, and wherein said step of disposing a sheath on each pipe is accomplished by disposing the sheath on the pipe overlapping the area to be encompassed by the concrete before the concrete is poured.

7. A method as recited in claim 1 wherein the sheath is polyvinyl chloride.

8. A combination comprising a floor or wall structure defining an interior building space, a plurality of utility pipes passing through said floor or wall including into the interior space, a loosely fitting sheath of flexible plastic material resistant to corrosive elements disposed around each of said pipes so that each sheath terminates shortly past the floor or wall in the interior building space and completely surrounding and protecting the pipe in the area thereof extending through the floor or wall, and so that relative thermal expansion and contraction between the pipe and the floor or wall can take place without destructive effects on the pipe, and said sheaths being of different colors and being disposed on a pipe indicating what utility is associated with that pipe.

9. A combination as recited in claim 8 wherein one of said pipes is a hot-water pipe and the other of said pipes is a cold-water pipe and wherein the sheath disposed around the cold-water pipe is blue and the sheath disposed around the hot-water pipe is red.

10. A combination as recited in claim 9 wherein said sheath is polyvinyl chloride.

11. A combination as recited in claim 10 wherein said floor or wall is concrete.

12. A combination as recited in claim 8 wherein said sheath is polyvinyl chloride.

13. A combination as recited in claim 8 wherein said floor or wall is concrete.

* * * * *